United States Patent [19]

Kraft et al.

[11] 3,991,877

[45] Nov. 16, 1976

[54] TRANSPORTATION APPARATUS

[75] Inventors: Joseph K. Kraft; Iber C. Courson, both of Gettysburg, Pa.

[73] Assignee: Westinghouse Electric Corporation, Pittsburgh, Pa.

[22] Filed: Feb. 20, 1975

[21] Appl. No.: 551,559

[52] U.S. Cl. ..... 198/335; 16/220; 52/584

[51] Int. Cl.[2] ..... B66B 9/12

[58] Field of Search ..... 198/16 R, 16 MS, 17, 198/18, 204; 104/25; 52/403, 753 D, 584; 292/256, 256.67, 256.71; 16/220

[56] References Cited

UNITED STATES PATENTS

| | | | |
|---|---|---|---|
| 1,533,725 | 4/1925 | Davenport | 292/256 |
| 3,321,059 | 5/1967 | Kroepel | 198/16 R |
| 3,353,650 | 11/1967 | Schroeder et al. | 198/16 R |

*Primary Examiner*—Evon C. Blunk
*Assistant Examiner*—Joseph E. Valenza
*Attorney, Agent, or Firm*—D. R. Lackey

[57] ABSTRACT

Transportation apparatus including a conveyor mounted on a support structure, and a balustrade formed of a plurality of panel members aligned in end-to-end relation. The lower edge of the balustrade is disposed in a support channel. A plurality of spaced clamp assemblies mounted on the support structure apply a bending force to the support channel which clamps the panel members firmly within the support channel and simultaneously clamps the support channel to the support structure.

15 Claims, 6 Drawing Figures

FIG.2
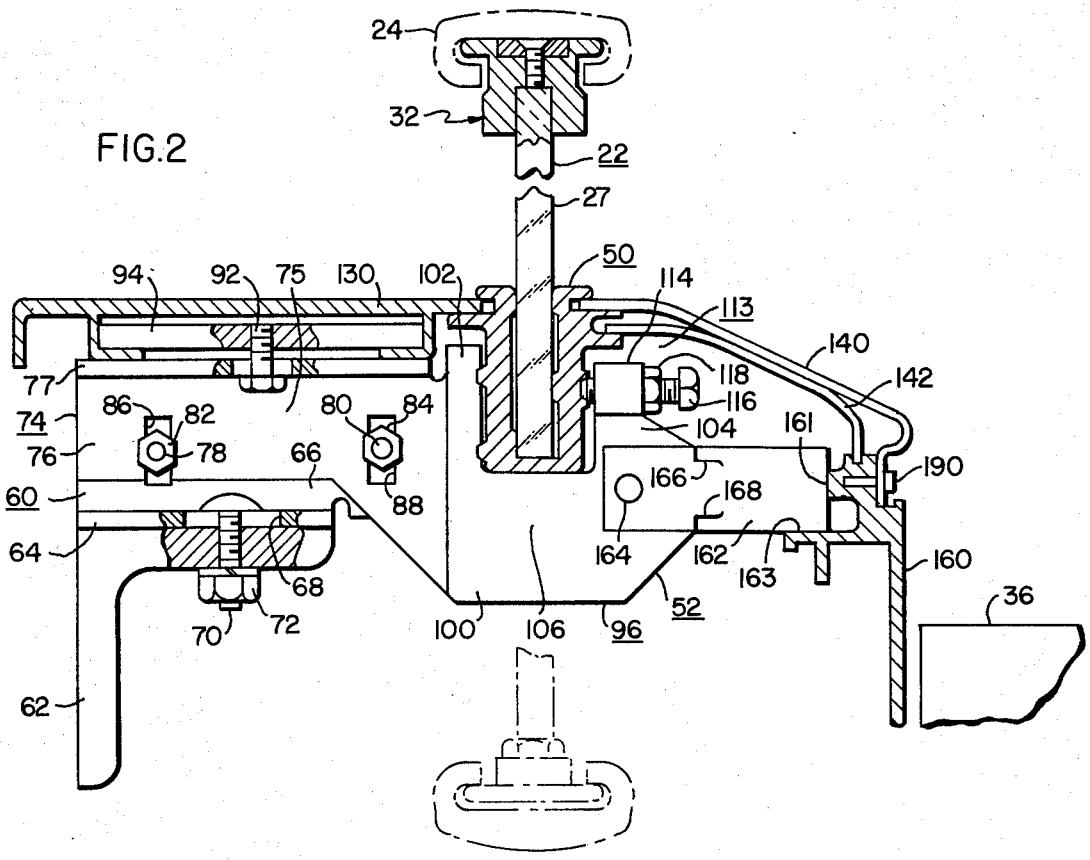
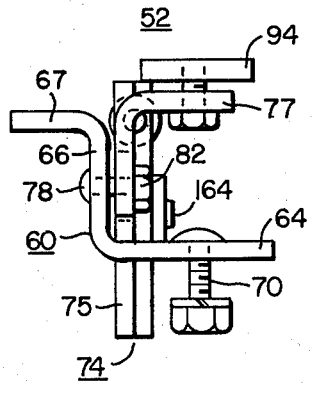
FIG.3

TRANSPORTATION APPARATUS

BACKGROUND OF THE INVENTION

1. Field of the Invention

The invention relates to transportation apparatus for moving people between spaced landings, such as moving stairways and walks.

2. Description of the Prior Art

Transportation apparatus for moving people from one landing to another, of the type which includes a belt, or a plurality of steps, platforms or pallets, such as moving stairways and walks, often utilize a plurality of transparent panel members aligned in end-to-end relation to provide a balustrade. U.S. Pat. Nos. 3,170,557, 3,283,878, 3,321,059, 3,353,650 and 3,653,484 illustrate transportation apparatus of this type. In the prior art, it is common to support and clamp the bottom edges of the panels in a relatively complex assembly which includes a first clamp member fastened to the truss and a second independent clamp member spaced from the first but connected thereto via a bolt which passes through an aperture in the second clamp member and is threaded into the first clamp member. while this arrangement is functionally satisfactory, it would be desirable to provide a new and improved support assembly for the panel members of the balustrade which provides easy adjustment of the balustrade relative to the truss at the time the balustrade is being assembled and mounted on the truss, which automatically vertically orients the panels of the balustrade during assembly thereof, and which accomplishes these objectives while simplifying the manufacture and assembly of the support components.

SUMMARY OF THE INVENTION

Briefly, the present invention is new and improved transportation apparatus having a balustrade formed of a plurality of panels aligned in end-to-end relation, which may be transparent. The bottom edges of the panels are disposed in an elongated support channel which has first and second leg portions and a bight portion. The support channel is dimensioned to bend in the area of the bight when one of its leg portions is urged towards the other. A plurality of clamp means are adjustably fastened to the truss of the apparatus in predetermined spaced relation along the direction of travel of the apparatus.

The elongated support channel which supports the panel members of the balustrade is placed in the plurality of clamp means, and the panels are placed in the support channel. Each of the clamp means is actuated to urge the second leg of the support channel towards the first leg, with this single action performing a dual clamping function, ie., the clamping of the panels in the support channel, and the clamping of the support channel to the truss.

Cooperatively spaced grooves and projections associated with the clamp means and outer surface of the first leg portion of the support channel positively lock the support channel to the clamp means when the second leg portion is urged towards the first, with this locking function also vertically orienting the first leg portion of the support channel. The inner surface of the first leg portion has two vertically spaced pad portions, the surfaces of which lie in a common vertical plane when the support channel is locked in the clamp means. The inner surface of the second leg portion includes a third pad portion disposed to provide a triangular pressure point on the panels, relative to the first and second pad portions, when the second leg portion is urged towards the first. Thus, the panels are forced against the vertically oriented surfaces of the first and second pad portions by the third pad portion, to vertically orient the panel members when the plurality of clamp means are actuated to urge the second leg portion of the support channel towards the first leg portion.

Longitudinal recesses in the outer surfaces of the first and second leg portions locate and hold inner and outer deck panels, as well as deck support members disposed at joints between abutting deck panels. These recesses also provide other important functions, such as making certain manufacturing tolerances less critical, facilitating installation and adjustment of the deck panels in the field, and providing the desired fit and blend between the support channel and the inner and outer deck panels.

The support channel has its leg and bight portions, as well as the associated first, second and third pad portions, and projections and grooves for the locking and locating functions, all arranged and configured to allow the support channel to be extruded to final shape.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 2 is a cross-sectional view of the transportation apparatus shown in FIG. 1, taken in the direction of arrows II—II, illustrating a support channel and clamp assembly for the balustrade constructed according to the teachings of the invention;

FIG. 3 is an end view of the clamp assembly shown in FIG. 2;

DESCRIPTION OF PREFERRED EMBODIMENTS

Figure 1:
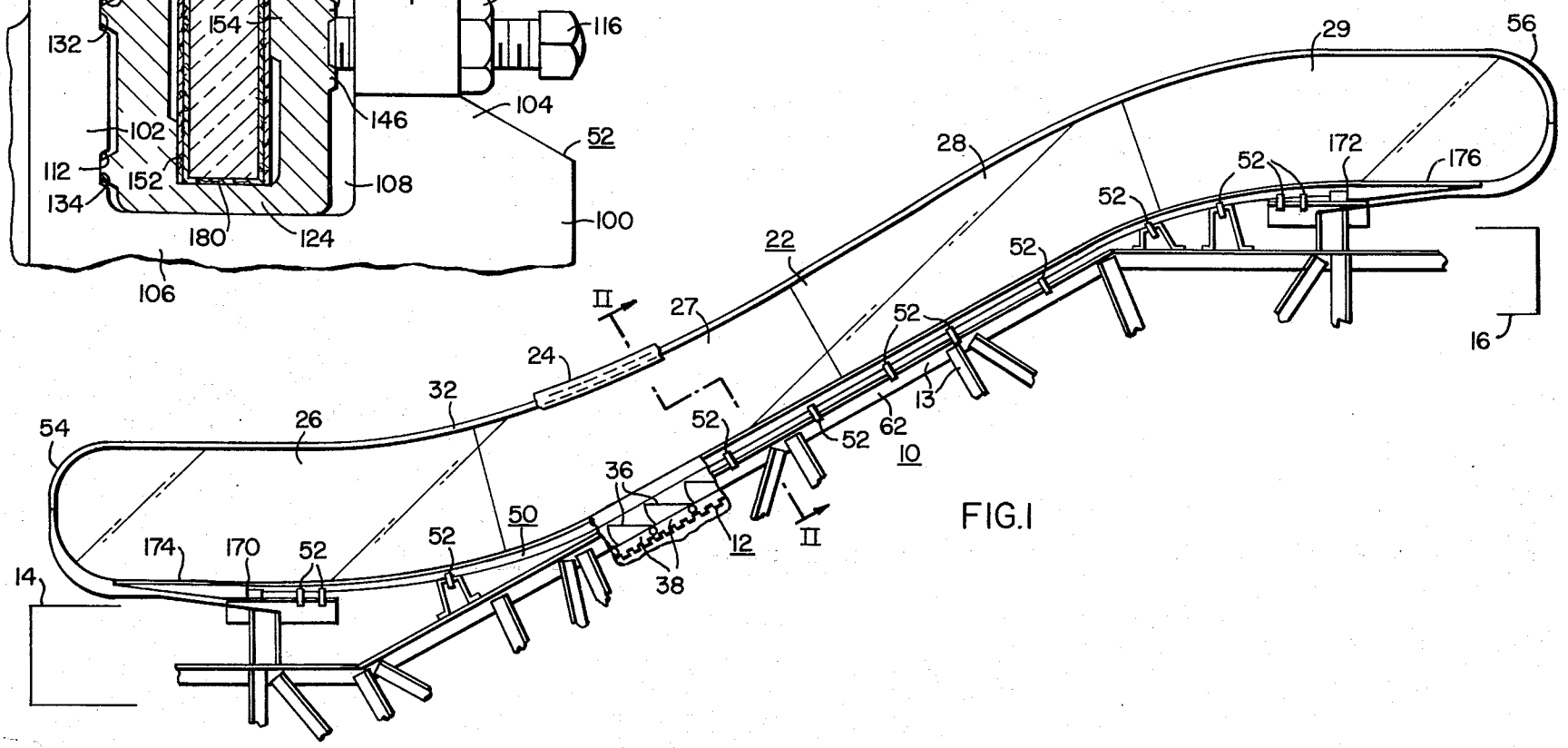
FIG. 1 is a view in side elevation of transportation apparatus which may be constructed according to the teachings of the invention.

Referring now to the drawings, and FIG. 1 in particular, there is shown transportation apparatus 10 of the type which may utilize the teachings of the invention. Transportation apparatus 10 employs a conveyor 12 for transporting passengers between a first landing 14 and a second landing 16. Conveyor 12 is preferably of the endless type conventionally used in moving walks and moving stairways. If the conveyor 12 is a moving walk, it may have a belt type treadway, or a pallet-type. For purposes of example, it will be assumed that the conveyor 12 is in the form of a moving stairway such as described in detail in U.S. Pat. Nos. 3,677,388, 3,682,289 and 3,707,220, which are assigned to the same assignee as the present application.

Conveyor 12, which is supported by a support structure or truss shown generally at 13, includes an upper load bearing run on which passengers stand, and a lower return run. A balustrade 22 is disposed above the conveyor 12 for guiding a continuous, flexible handrail 24. The balustrade 22 guides the handrail 24 about the upper run of a closed handrail loop, which also includes a lower run. The lower run is not shown in FIG. 1, but it is illustrated in phantom in FIG. 2. A balustrade similar to balustrade 22 is spaced from balustrade 22 to provide two spaced handrails which may be grasped by passengers, but since the second balustrade is similar in structure to the first, only one balustrade is illustrated.

Balustrade 22 is formed of a plurality of vertically oriented panel members 26, 27, 28 and 29 aligned in end-to-end relation to define substantially continuous upper and lower edge portions. The panel members are preferably transparent, such as tempered glass, having a thickness dimension of about 0.5 inch (12.7 mm.), and the invention will be described assuming that the panel members are formed of glass. However, it is to be understood that the panel members may be formed of any other suitable material such as metallic or plastic panel members.

The handrail 24 may be guided over the upper edge of the balustrade 22 by new and improved guide means 32, which is disclosed and described in co-pending application Ser. No. 551,558, filed Feb. 20, 1975, (identified by assignee's, or a conventional guide arrangement may be used.

Conveyor 12 includes a plurality of steps 36, only a few of which are illustrated in FIG. 1. The steps 36 move in a closed path, with the conveyor 12 being driven in a conventional manner, such as illustrated in U.S. Pat. No. 3,414,109, or the conveyor may be driven by a modular drive arrangement as disclosed in the hereinbefore mentioned U.S. Pat. Nos. 3,677,388, 3,682,289 and 3,707,220. As disclosed in these three patents, the conveyor 12 includes a endless belt formed of toothed links 38 to which the steps 36 are connected. The endless belt and steps 36 are driven by a modular drive unit (not shown) which includes sprocket wheels and a drive chain for engaging the toothed links 38.

The balustrade 22 is mounted on the support structure or truss 13 according to the teachings of the invention, with the new improved mounting means including elongated support channels 50, disposed in end-to-end relation, with the lower edges of the panel members of the balustrade 22 being disposed in the recess of the support channels 50, and a plurality of clamp assemblies 52 which are fastened to the truss 13 in spaced relation, which lock the support channels 50 to the truss 13 and simultaneously bend the support channels to clamp and vertically orient the panel members of the balustrade 22. The support of the balustrade at the cantilevered lower and upper newel sections 54 and 56, respectively, may be conventional, but it is preferable that the support structure at the newels 54 and 56 is the new and improved support arrangement disclosed and described in co-pending application Ser. No. 551,560, filed Feb. 20, 1975, which is assigned to the same assignee as the present application.

More specifically, the new and improved balustrade support arrangement is illustrated in detail in FIG. 2, which is a cross-sectional view of the transportation apparatus 10 shown in FIG. 1, taken generally between arrows II—II. FIGS. 3, 4, 5 and 6 will also be referred to when describing the balustrade support arrangement, with FIGS. 3 and 4 being end and perspective views, respectively, of the clamp assembly 42 shown in FIG. 2, FIG. 5 being an enlarged cross-sectional view of the support channel 50, and FIG. 6 being a perspective view of the support channel 50 and clamp assembly 52 in assembled relation.

Figure 4:
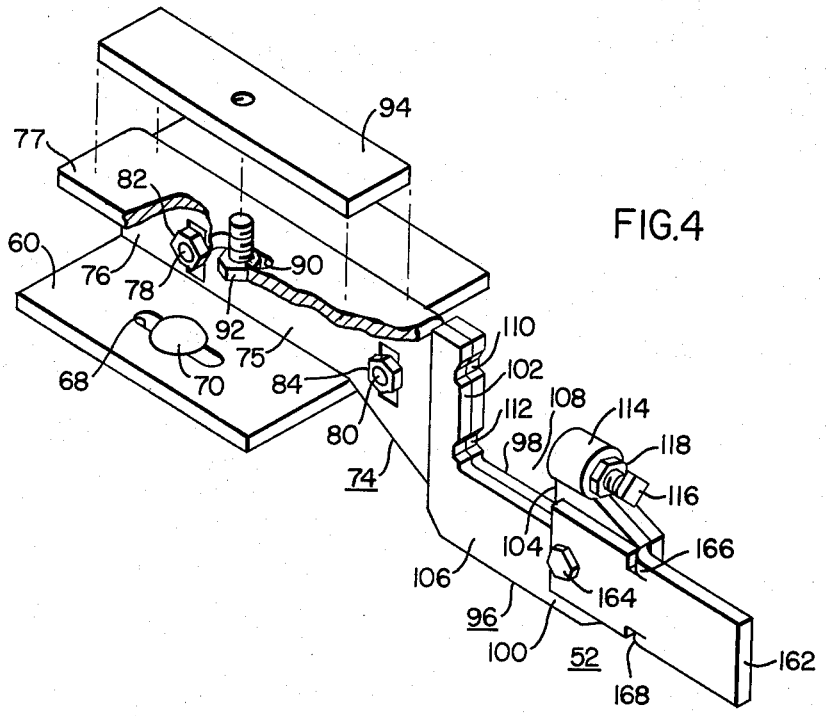
FIG. 4 is a perspective view of the clamp assembly shown in FIGS. 2 and 3.
Figure 6:
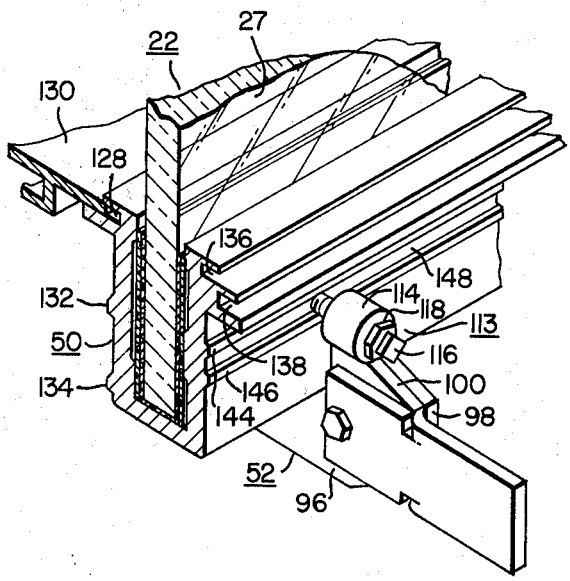
FIG. 6 is a perspective view of the support channel and clamp assembly shown in FIG. 2.

Clamp assembly 52 includes a mounting bracket 60 which mounts on the truss chord 62 of the truss 13. Mounting bracket 60 is a Z-shaped bracket, best illustrated in the end view of the clamp assembly 52 shown in FIG. 3. Bracket 62 includes a portion 64 which mounts directly on the truss chord 62, a portion 66 which extends outwardly from portion 64 such that the flat major opposed surfaces of portion 66 are perpendicular to those of portion 64, and a portion 67, which is parallel to portion 64. Portion 64 does not extend for the full length of the bracket 60, as illustrated in FIG. 2, but portion 67 provides support for portion 66 across the complete length of the bracket. An opening 68 is disposed through portion 64 for receiving a bolt 70 which extends through an aperture in the truss chord 62. As best illustrated in FIG. 4, opening 68 is in the form of a slot oriented to provide horizontal or side-to-side adjustment for bracket 60, i.e., adjustment in a direction perpendicular to the direction of travel of transportation apparatus 10. A nut and washer shown generally at 72 secures the bolt 70 and bracket 60 firmly to the truss chord 62. Clamp assembly 52 further includes a clamp bracket 74 having a first portion 76 which is in the form of an inverted L, having a main mounting portion 75 and an outer deck mounting portion 77. The main mounting portion 75 is attached to the upstanding portion 66 of mounting bracket 60 via suitable openings in portions 76 and 66, first and second bolts 78 and 80, and their cooperative nuts 82 and 84, respectively. As best illustrated in FIG. 2, the openings in portion 75 of clamp bracket 74 are slotted, with these openings or slots being referenced 86 and 88. The slots 86 and 88 are oriented to provide a vertical adjustment for the clamp assembly 52, i.e., adjustment in a plane perpendicular to the adjustment provided by slot 68.

The outer deck mounting portion 77 includes an opening 90 in the form of a slot which is oriented in the same direction as slot 68, and a bolt 92 extends through opening 90 and is threadably engaged with an outer deck clamp member 94.

The clamp bracket 74 includes a second portion 96 attached to the first portion 76 which extends outwardly from the truss chord 92 to provide a support for the support channel 50. The second portion 96 includes an integral extension 98 of the plate member which formed the main mounting portion 75, and an additional flat plate member 100 superimposed on the extension 98 which is welded or otherwise attached to extension 98 to increase the thickness dimension of the second portion 96. The second portion 96 of the clamp bracket 74 includes first and second horizontally spaced upstanding leg portions 102 and 104, respectively, connected by a bight portion 106, which cooperate to define a substantially U-shaped recess 108 for receiving the support channel 50. The first leg portion 102 includes first and second vertically spaced locking notches or recesses 110 and 112, respectively, which cooperate with the support channel 50 to properly orient and lock the support channel, as will be hereinafter explained. The second leg portion 104 is terminated with means 113 for applying an adjustable clamping pressure to the support channel 50. Means 113 includes a cylindrical member or nut 114 having a threaded opening. Nut 114 is fixed to the upstanding end of leg portion 104, such as by welding. A clamp screw 116 and a jam nut 118 complete the pressure applying means 113.

Figure 5:
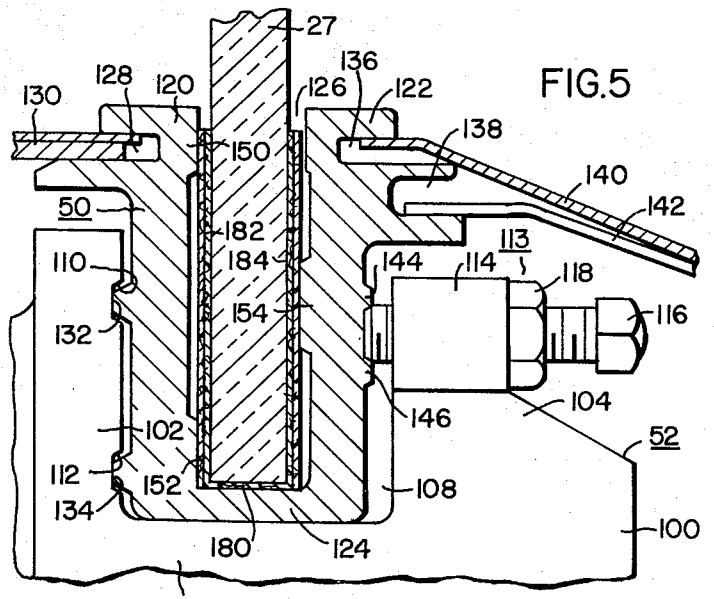
FIG. 5 is an enlarged view of the support channel shown in FIG. 2.

The elongated support channel 50, best shown in FIG. 5, which is an enlarged view of the support channel shown in FIG. 2, includes first and second horizontally spaced, upstanding leg portions 120 and 122 and a bight 124 which connects the leg portions 120 and 122 at their lower ends to cooperatively define a substantially U-shaped recess 126 for receiving the panel members of the balustrade 22.

The outer surface of the first leg portion 120 includes a longitudinal groove 128 for receiving an edge of an outer deck panel 130, and vertically spaced first and second longitudinal projections 132 and 134, respectively, which extend in parallel relation for the length of the support channel 50. Projections 132 and 134 are dimensioned and located to enter the locking and orienting notches 110 and 112, respectively, of the clamping assembly 52.

The outer surface of the second leg portion 122 includes first and second vertically spaced longitudinal grooves 136 and 138 for receiving edges of an inner deck panel and an inner deck support member 142, respectively. The outer surface of the second leg portion 122 also includes first and second vertically spaced longitudinal projections 144 anad 146 which extend in parallel relation for the length of the support channel. Projections 144 and 146 are spaced and located to define a surface 148 between them against which pressure will be applied by means 113. Surface 148 is approximately midway between the upper and lower ends of the second leg portion 122.

The inner surface of the first leg portion 120 includes first and second vertically spaced pressure pad portions 150 and 152 which are projections on the inner surface which extend into the recess 126 at the upper and lower ends thereof. The pressure pad portions 150 and 152 extend over the complete length of the support channel 50. The inner surface of the second leg portion 122 includes a single pressure pad portion 154 formed by a projection on the inner surface located about midway between the upper and lower ends of the second leg portion 122. Pressure pad portion 154 also extends over the complete length of the support channel 50.

The support channel 50 is constructed to function as a clamp on the panel members which form the balustrade when pressure is applied to its second leg portion by means 113. The clamping action is provided by bending the support channel member 50, with the support channel member 50 being configured and dimensioned to bend in the bight 124. As illustrated most clearly in FIG. 5, the bight 124 is substantially thinner than the leg portions 120 and 122. When the support channel is an aluminum extrusion, suitable thickness dimensions are about 0.187 inch (4.75 mm.) for the bight and about 0.343 inch (8.71 mm.) for the leg portions, but other dimensions may be used.

Skirt panels 160 shown in cross-section in FIG. 2, which have previously been attached to suitable skirt mounting brackets and properly plumbed, are used to locate the clamp assemblies 52 during the installation of the balustrade 22. The skirt 160 includes first and second surfaces 161 and 163 which are used for locating the clamp assembly 52. Each clamp assembly 52 includes a field installation bracket 162 which is removably fixed to the second portion 96 of the clamp bracket 74 via a nut and bolt assembly 164. Bracket 162 includes tabs 166 and 168 which properly orient bracket 162 relative to the clamp assembly 52. Clamp assembly 52 is horizontally adjusted via the bolt 70, and vertical adjusted via bolts 78 and 80 until bracket 162 contacts the skirt at both of the locating surfaces 161 and 163.

The proper number of straight and curved support channels 50 are then placed end-to-end in the recesses 108 defined by the clamp assemblies 52, starting at point 170 of the lower newel section 54 and extending to point 172 of the upper newel section 56. As hereinbefore explained, the cantilevered balustrade support at the lower and upper newels 54 and 56, respectively, shown generally at 174 and 176, may be conventional, or, preferably, it is a new and improved support arrangement disclosed in the hereinbefore mentioned co-pending application Ser. No. 551,560.

After the support channels 50 are placed in the clamp assemblies 52, a strip 180 of suitable glass padding material, best shown in FIG. 5, is disposed to line the bottom of the recess 126 of the support channel 50, such as elastomeric or rubberized fabric having a thickness dimension of 0.0625 inch (1.59 mm.) and a width dimension which enables it to cover the complete bottom of the recess. A panel member such as panel 27 is then placed into the recess of the support channel 50 and additional strips of padding are disposed within the recess between the sides of the panel 27 and the support channel 50. This additional padding material is shown generally at 182 and 184.

The clamp screw 116 of each clamp assembly 52 is then advanced to contact and to urge the second leg portion 122 of the support channel 50 towards the first leg portion, which first presses the projections 132 and 134 into the locking notches 110 and 112 to vertically orient the first leg portion 120 of the support channel, and then continued advancement of the clamp screw 116 bends the support channel 50 in the area of the bight 124. Pressure pad 154 located on the inner surface of the second leg portion 122 presses the panel member 27 against the spaced first and second pad portions 150 and 152 on the inner surface of the first leg portion 120, vertically orienting the panel member as well as firmly clamping the panel member within the support channel via three contact pad portions. The clamping action provided by the clamp assembly 52 thus clamps each panel member within the support channel 50 and simultaneously clamps the support channel 50 to the clamp assemblies and thus to the truss 13.

The outer deck panels 130 may then be assembled, using the outer deck clamp 94 to secure the panels 130 in position. An edge of the outer deck panel 130 extends into recess 128 provided in the support channel, with the recess being sized to allow adjustment of the outer deck panels to accommodate manufacturing tolerances.

The inner deck panels may now be assembled by placing narrow inner deck support strips 142 where the ends of adjacent inner deck panels 140 abut one another, and then the inner deck panels may be assembled. The inner deck support strips have one end inserted into recess 136 in the support channel 50, and the other end inserted into a recess in the skirt panel 160. The inner deck panel 140 is installed by inserting one edge into recess 136 in the support channel 50, and by fastening the opposite edge to the skirt panel 160 via a plurality of screws, such as screw 190.

In summary, there has been disclosed new and improved transportation apparatus such as moving electric walks and stairways which include a balustrade formed of a plurality of panels disposed in end-to-end relation to provide a substantially continuous lower edge surface. The panel members are disposed in elongated support channel members, which may be extruded to shape, and the support channels are supported in a plurality of spaced clamp assemblies which are adjustably fixed to the truss of the transportation apparatus. Each clamp assembly includes means for urging one side of the support channel towards the other, bending the support channel in the bight thereof, to simultaneously clamp the panel members within the support channels and the support channels to the support truss. The clamp assemblies and support channel include cooperative recesses and projections which vertically orient one leg of the support channel and lock the support channel to the clamp assemblies, and three pressure pads within the support channel recess which vertically orient and clamp the panel members.

We claim as our invention:

1. Transportation apparatus for transporting persons between spaced landings, comprising:

a support structure, a load bearing conveyor mounted on said support structure, a balustrade, and means supporting said balustrade on said support structure, said balustrade including a plurality of vertically oriented panel members aligned in end-to-end relation to define a substantially continuous bottom edge portion, said means mounting the balustrade on the support structure including a support channel and a plurality of clamp means, with said clamp means being mounted in spaced relation on the support structure, and with said support channel being disposed in said spaced clamp means, said support channel including first and second spaced leg portions and a bight which cooperatively define an elongated recess having a length dimension selected to receive substantially the complete length of the bottom edge portion defined by the aligned panel members, said plurality of clamp means applying bending forces to said support channel which cooperate to provide a clamping force on said panel members along substantially the complete length of said support channel, to clamp the panel members in the support channel and to simultaneously clamp the support channel to the support structure.

2. The transportation apparatus of claim 1 wherein each of the plurality of clamp means is disposed to urge one of the first and second leg portions of the support channel towards the other, and the support channel is dimensioned to bend at the bight in response to such urging.

3. The transportation apparatus of claim 2 wherein each of the clamp means and the other surface of the first leg portion of the support channel include means which cooperate to lock the support channel to the clamp means and vertically orient the first leg portion when the clamp means urges the second leg portion towards the first leg portion of the support channel.

4. The transportation apparatus of claim 3 wherein the inner wall of the first leg portion of the support channel includes first and second vertically spaced pad portions and the inner wall of the second leg portion includes a third pad portion located to provide a triangulation pressure point which vertically orients the panel members against the first and second pad portions when the second leg portion is urged towards the first leg portion.

5. The transportation apparatus of claim 1 wherein the inner surface of the first leg portion of the support channel includes first and second vertically spaced pressure pads having surfaces in a common vertical plane, and the inner surface of the second leg portion includes a third pressure pad vertically oriented between the first and second pressure pads to provide a triangular pressure point, and wherein the clamp means adjustably urges the second leg portion and its associated third pressure pad towards the first leg portion, to clamp the panel members against the first and second pressure pads and vertically orient the panel members.

6. The transportation apparatus of claim 5 wherein the first and second leg portions and the bight of the support channel are dimensioned to cause the support channel to bend at the bight when the second leg portion is urged towards the first leg portion.

7. The transportation apparatus of claim 1 wherein the clamp means includes a clamp assembly having first and second horizontally spaced portions and a connecting bight which cooperate to define a U-shaped recess, with the bight of the support channel resting on the bight of the clamp assembly, with the channel member being clamped between the first and second spaced members of the clamp assembly, and wherein the second member of the clamp assembly includes means for adjustably urging the second leg portion of the support channel towards the first leg portion to bend the support channel and cause the support channel to clamp the panel members.

8. The transportation apparatus of claim 7 wherein the support channel is dimensioned such that when the second leg portion is urged towards the first leg portion the support channel bends at the bight.

9. The transportation apparatus of claim 7 wherein the first member of the clamp assembly and outer surface of a first leg portion of the support channel includes cooperatively located grooves and projections which vertically orient the first leg portion of the support channel at at least two vertically spaced locations, the second member of the clamp assembly includes a member in threaded engagement therewith which provides an adjustable pressure against the second leg portion of the support channel, and the outer surface of the second leg portion includes means defining the location where the adjustable pressure is to be applied.

10. Transportation apparatus for transporting persons between spaced landings, comprising:

a support structure, a load bearing conveyor mounted on said support structure, a balustrade, and means supporting said balustrade on said support structure, said balustrade including a plurality of vertically oriented panel members aligned in end-to-end relation to define a substantially continuous bottom edge portion, said means mounting the balustrade on the support structure including a support channel and a plurality of clamp means, said support channel including first and second spaced leg portions and a bight which cooperatively define a recess in which the bottom edge portion defined by the aligned panel members is disposed, said plurality of clamp means being mounted in spaced relation on said support structure, said plurality of clamp means applying a bending force to said support channel which clamps the panel members in the support channel and simultaneously clamps the support channel to the support structure, said clamp means including a clamp assembly having first and second horizontally spaced portions and a connecting bight which cooperate to define a U-shaped recess, with the bight of the support channel resting on the bight of the clamp assembly, and with the channel member being clamped between the first and second spaced members of the clamp assembly, said second member of the clamp assembly including means for adjustably urging the second leg portion of the support channel towards the first leg portion to bend the support channel and cause the support channel to clamp the panel members, said clamp assembly including adjustment means which provides adjustment of the clamp assembly relative to the support structure in horizontal and vertical planes, with the direction of adjustment in the horizontal and vertial planes being substantially transverse to a line between the spaced terminals, and parallel to this line, respectively.

11. The transportation apparatus of claim 1 wherein the panel members are transparent.

12. The transportation apparatus of claim 1 wherein the panel members are tempered glass.

13. The transportation apparatus of claim 1 including a first deck member, and wherein the leg portion of the support channel defines a recess for receiving an edge of said first deck member and the clamp means includes a clamp member for clamping the first deck member to the clamp means.

14. The transportation apparatus of claim 13 including a second deck member and a skirt member, and wherein the second leg portion defines a recess for receiving an edge of said second deck member.

15. The transportation apparatus of claim 14 including a deck support member disposed below the second deck member in contacting relation therewith, and wherein the second leg portion and skirt member each define recesses for receiving an edge of said deck support member.

* * * * *